United States Patent [19]

Hussey

[11] Patent Number: 4,982,814

[45] Date of Patent: Jan. 8, 1991

[54] ELEVATOR SAFETY BARRICADE

[76] Inventor: Daniel J. Hussey, 115 Bing Blvd., Bridgeton, Mo. 63044

[21] Appl. No.: 417,436

[22] Filed: Oct. 5, 1989

[51] Int. Cl.[5] ..... B66B 13/00

[52] U.S. Cl. ..... 182/230; 182/113; 187/98

[58] Field of Search ..... 182/113, 230; 49/57, 49/463, 61, 63; 52/106; 256/64; 187/98

[56] References Cited

U.S. PATENT DOCUMENTS

| | | | |
|---|---|---|---|
| 1,585,592 | 5/1926 | McArthur | 49/57 |
| 2,289,844 | 7/1942 | Lamb | 182/113 |
| 3,224,048 | 12/1965 | Sullivan | 49/57 |
| 3,675,613 | 7/1972 | Sayles | 256/64 |
| 4,321,771 | 3/1982 | Koike . | |
| 4,399,635 | 8/1983 | Darga | 49/57 |
| 4,437,265 | 3/1984 | Turro | 49/57 |
| 4,590,706 | 5/1986 | Plowman . | |
| 4,598,508 | 7/1986 | Baum . | |

*Primary Examiner*—Reinaldo P. Machado
*Attorney, Agent, or Firm*—Haverstock, Garrett and Roberts

[57] ABSTRACT

An elevator safety barricade adapted to prevent inadvertent entry into an elevator shaft comprised of a pair of opposed pockets in the opposite side plates of an elevator opening and a pair of overlapping restraining bars with one end of each restraining bar inserted into each of the openings. The pair of restraining bars are held in place in rigid relationship with each other to provide a rigid barricade.

6 Claims, 2 Drawing Sheets

ELEVATOR SAFETY BARRICADE

BACKGROUND OF THE INVENTION

The present invention relates in general to elevator safety barricades and more particularly to a device which may be incorporated into existing elevator openings or included in new constructions.

U.S. Pat. No. 4,598,508 discloses a device for securing building shafts against forceable entry and is particularly concerned with the anti-intrusion function. U.S. Pat. No. 4,399,635 discloses a removable barn gate for restraining animals. The constructions disclosed in these patents are intended as relatively permanent installations for the stated purposes and the devices are very different from the present invention which is directed to an inexpensive, easily usable construction for temporarily barricading an elevator shaft while the elevator equipment is being serviced or repaired.

SUMMARY OF THE INVENTION

This invention includes mounting a heavy duty plate with pockets in the facing plates on each side of an elevator opening, with the pockets adapted to receive bar inserts.

One end of a cross-bar can be inserted into one of the opposed pockets in the side plates and the other cross-bar can be inserted into the pocket in the side plate on the opposite side of the elevator opening so that the cross-bars overlap. The restraining cross-bars can be held in overlapping relationship with each other and in rigid position by means adapted for locking the cross-bars together in rigid relationship.

Once the restraining cross-bars are locked in rigid position, a warning sign may be optionally attached to the cross-bars.

DETAILED DESCRIPTION OF THE INVENTION

Following is a detailed description of the invention where like numbers are used to show like parts in the several figures.

Figure 1:
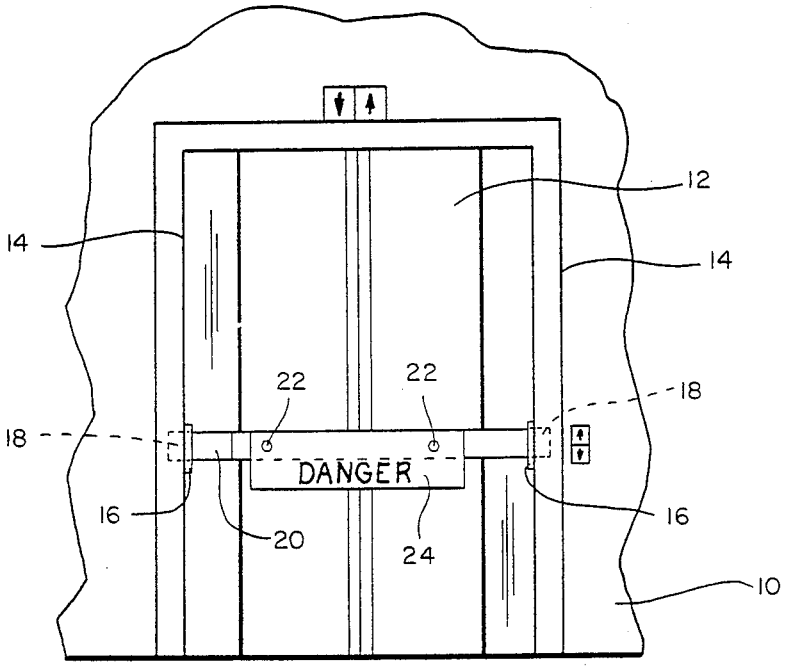
FIG. 1 is a front elevation of an elevator opening showing the safety barricade of this invention in place.

With reference to FIG. 1, the elevator door opening 10 is shown with barricade 11 in place across door openings 12. Opposed door side facing plates 14 contain side pocket plates 16. Side pocket plates 16 contain pockets 18 adapted for retaining in place the ends of respective restraining bars 20. Overlapping restraining bars 20 are held in place in regid relationship with each other by means of bar locking means 22. Bar locking means 22 may be any of the well known means for attaching one piece of apparatus to another such as bolts and nuts, clamps, pins and keys, etc. For ease of use and ready availability, bolts with winged nuts are preferred in the practice of this invention.

Optionally, danger sign 24 may be attached to the cross-bars. A convenient way to attach danger sign 24 to the cross-bars would be to have the sign with a pair of holes through which the bar locking means is inserted as part of barricade 11. The danger sign is adapted to display attention getting slogans such as "YOUR NEXT STEP WILL BE YOUR LAST". Also, flashing lights may be attached to the danger sign.

Figure 2:
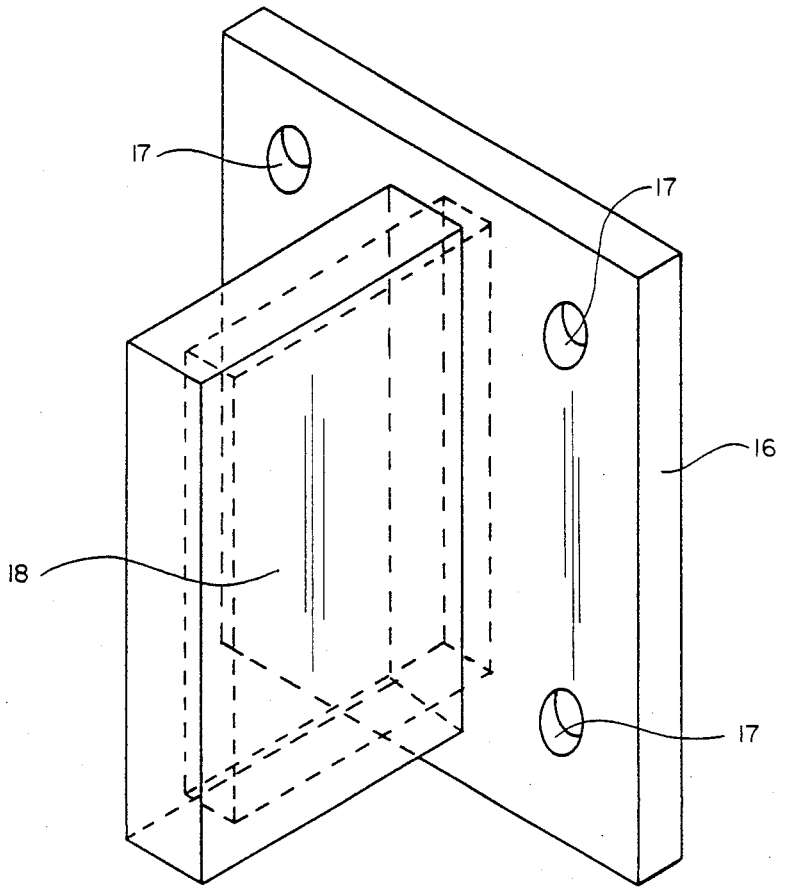
FIG. 2 is a rear perspective showing one facing plate and pocket.

With reference to FIG. 2, side pocket plate 16 includes openings 17 which are adapted to mate with openings in door side facing plates 14 for opposed installation after an elevator and shaft has been placed in service. Side pocket plate 16 and pocket 18 may be installed by cutting an opening in door side facing plate 14 so that side pocket plate 16 may be rigidly attached to door side facing plate 14 with pocket 18 extending inward from the plane of door side facing plate 14. When this invention is incorporated into new construction, an opening can be cut in the door side facing plate 14 and pocket 18 can be attached directly to door side facing plate 14 without the requirement for including a side pocket plate.

Figure 3:
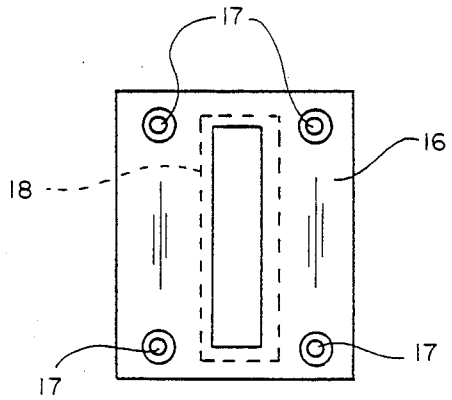
FIG. 3 is a front elevation showing the facing plate and pocket in place on a side facing panel.

FIG. 3 is a front elevational drawing of side pocket plate 16 with pocket 18 incorporated therein and side pocket plate openings 17 adapted for attaching side pocket plate 16 containing side pocket plate opening 17 onto door side facing plate 14.

Figure 4:
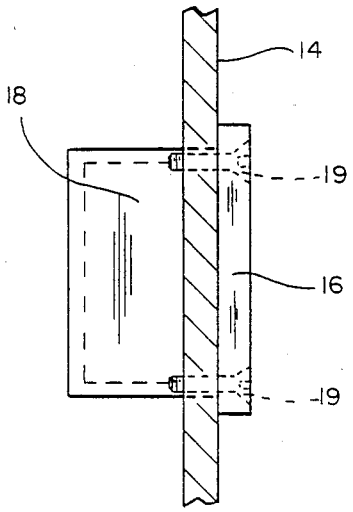
FIG. 4 is a side elevation of the facing plate and the pocket shown in FIG. 3; and, FIG. 5 shows a preferred embodiment in preassembled exploded view.

FIG. 4 shows a side elevation of FIG. 3 wherein side pocket plate 16 containing pocket 18 is shown attached to door side facing plate 14 by fasteners 19.

Figure 5:
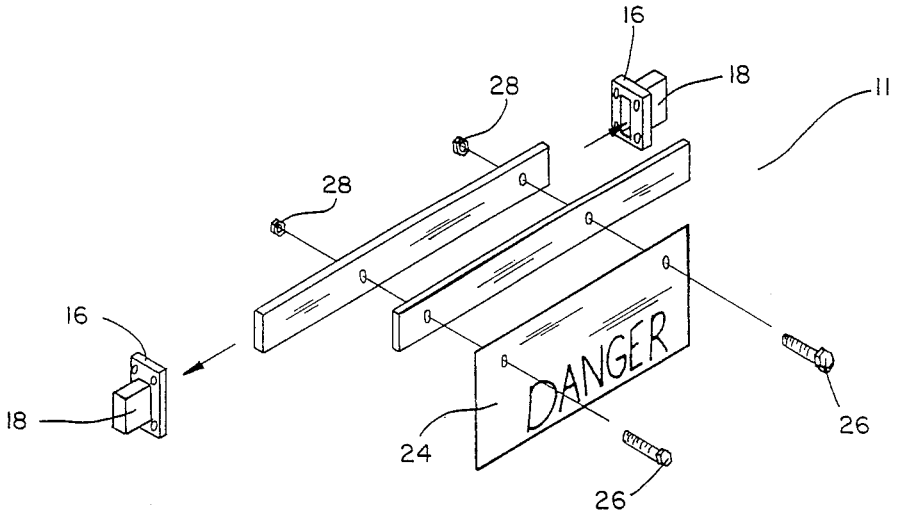

FIG. 5 shows an exploded view of this invention disassembled to show how the various components connect together. Side pocket plate 16 containing pockets 18 are shown with bars 20 ready for insertion into pockets 18 adapted for attachments to each other by means of bolts 26 and nuts 28. Also, danger sign 24 is shown adapted for being locked in place on bars 20 by means of bolts 26 and nuts 28.

The cross-bars of this invention may be constructed of any known material such as aluminum, steel, wood, reinforced plastics, etc. Because of light-weight and durability, aluminum is generally preferred.

The side pocket plate and pocket may be preferably constructed of metals such as steel, aluminum, etc. Also useful in the practice of this invention and preferable for some services such as elevators in plants subject to corrosive elements, are plastic compositions capable of withstanding forces of about 200 PSI and higher. Such plastics include polycarbonates, reinforced polyamides, polyolefins such as polypropylene, polyurethanes, acrylonitrile-butadiene-styrene copolymers, polyvinylchlorides and other known plastics suitable for the indicated purpose. Also, the side pocket plate and pocket may be made as two parts and attached together in any conventional manner such as welding, particularly when the parts are fabricated form a metal, or the side pocket plate and pocket may be preferably fabricated as a single unit, particularly when made from molded plastic compositions.

Thus, there has been shown and described a novel elevator safety barricade which may be incorporated into existing elevator openings or included in new constructions which construction fulfills all of the object and advantages sought therefor. Many changes, modifications, variations and other uses and applications of the construction will, however, become apparent to those skilled in the art after considering this specification and the accompanying drawings. All such changes, modifications, variations and other uses and applications which do not depart from the spirit and scope of the invention are deemed to be covered by the invention, which is limited only by the claims which follow

I claim:

1. An elevator safety barricade adapted to prevent inadvertent entry into an elevator shaft consisting essentially of: a pair of opposed pockets in the opposite side plates of an elevator opening, said opposed pockets being recessed in space back of the respective opposite side plates, a pair of overlapping restraining bars adapted for an opposing end of each of said restraining bars to be insertable into and mate with said opposed pockets, and, means for holding said overlapping restraining bars in rigid abutting relationship in order to provide a barricade to prevent inadvertent entry into said elevator shaft.

2. The invention according to claim 1 wherein said opposed pockets are attached to and made a part of a side pocket plate adapted to be attached to the door side facing plates for after construction installation.

3. The invention according to claim 1 wherein said overlapping restraining bars are held in rigid abutting relationship by means of a pair of bolts and nuts.

4. The invention according to claim 3 wherein a danger sign is attached to said barricade.

5. The invention according to claim 1 wherein said overlapping restraining bars are made from aluminum, steel, wood, or reinforced plastics.

6. The invention according to claim 5 wherein said overlapping restraining bars are made from aluminum.

* * * * *